US007814763B2

(12) United States Patent
Tavolazzi et al.

(10) Patent No.: US 7,814,763 B2
(45) Date of Patent: Oct. 19, 2010

(54) REFRIGERATION APPLIANCE WITH A WATER DISPENSER

(75) Inventors: Stefano Tavolazzi, Verbania-Intra (IT); Lorenzo Bianchi, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 127 days.

(21) Appl. No.: 11/869,998

(22) Filed: Oct. 10, 2007

(65) Prior Publication Data

US 2008/0087036 A1 Apr. 17, 2008

(30) Foreign Application Priority Data

Oct. 12, 2006 (EP) ..... 06122207

(51) Int. Cl.
*B67D 5/62* (2006.01)

(52) U.S. Cl. ..... 62/389; 62/390; 62/338

(58) Field of Classification Search ..... 62/389, 62/338–339

See application file for complete search history.

(56) References Cited

U.S. PATENT DOCUMENTS

| | | | | |
|---|---|---|---|---|
| 5,502,978 | A * | 4/1996 | Field | 62/157 |
| 7,284,680 | B2 * | 10/2007 | Farano et al. | 222/52 |
| 2006/0130512 | A1 * | 6/2006 | Seo | 62/389 |

FOREIGN PATENT DOCUMENTS

| | | | |
|---|---|---|---|
| EP | 1574797 | A2 | 9/2005 |
| FR | 2511763 | A1 | 2/1983 |
| WO | 03033976 | A1 | 4/2003 |

* cited by examiner

*Primary Examiner*—Cheryl J Tyler
*Assistant Examiner*—Lakiya Rogers
(74) *Attorney, Agent, or Firm*—John W. Morrison; McGarry Bair, P.C.

(57) ABSTRACT

A refrigeration appliance includes at least one water reservoir and a piping system connecting the water reservoir to a water dispenser and device for maintaining the water reservoir at a predetermined temperature. The piping system is designed for allowing a recirculation of water from and to the water reservoir in order to assure that the water delivered by the dispenser is at the correct temperature.

5 Claims, 3 Drawing Sheets

REFRIGERATION APPLIANCE WITH A WATER DISPENSER

BACKGROUND OF THE INVENTION

1. Field of the Invention

The present invention relates to a refrigerator comprising at least a water reservoir, a piping system connecting the water reservoir to a dispenser and means for maintaining the water reservoir at a predetermined temperature. In the present description, with the term water we include also still or carbonated water and any kind of beverages, carbonated or not.

2. Description of the Related Art

Refrigerators with a beverage dispenser are well known in the art. Such dispensers are particularly but not exclusively used in the so-called side by side refrigerators in which a freezing chamber is provided side by side to a chilling chamber. Usually the dispenser for water and other beverages is placed in a case of the door of the freezing chamber, particularly because the dispenser is used also for dispensing ice cubes or crushed ice produced by an ice-maker inside the freezing chamber. The reservoir for cold water is usually placed in the chilling chamber and it is maintained at the same temperature of such compartment. The reservoir can be a predetermined length of rolled up tube placed in the chilling chamber. In this case the above mentioned means for maintaining the water in the reservoir at a predetermined temperature is the cooling system of the chilling chamber. If the reservoir is used for storing hot water, usually it is placed outside the refrigerator compartments, for instance in the base zone of the refrigerator where it is also possible to use the heat released from the condenser to pre-heat the incoming water.

Standard refrigerators like the side by side model mentioned above have a pipe inside the foam insulation which connects an external water supplying source, such as a tap, to the reservoir, through the door and then to the dispenser area. Such pipe can have a total length of about two meters or more.

When consumer pushes the paddle on the dispenser, the water that is driven by the water pressure of the main comes out; when the paddle is released, the water flow stops.

At this time the cold (or hot) water inside this pipe start to become warm (or cold), because of ambient temperature influence. So the first glass of water at the next dispensing is water at almost ambient temperature. Therefore the user is either provided with water not at the correct temperature or he/she can think the appliance is not working properly.

SUMMARY OF THE INVENTION

An object of the present invention is to provide a refrigeration appliance of the type mentioned above which can dispense water at the desired temperature anytime, independently on the temperature of the water left in the piping system by previous dispensing. With the term "refrigeration appliance" we mean not only refrigerators and freezers, but also beverage vending machines, or water coolers.

BRIEF DESCRIPTION OF THE DRAWINGS

This object is achieved thanks to the features listed in the appended claims. Other features, aspects and advantages of the present invention will become more apparent from the following detailed description with reference to the accompanying drawings in which:

DETAILED DESCRIPTION OF THE PREFERRED EMBODIMENTS

Figure 2:
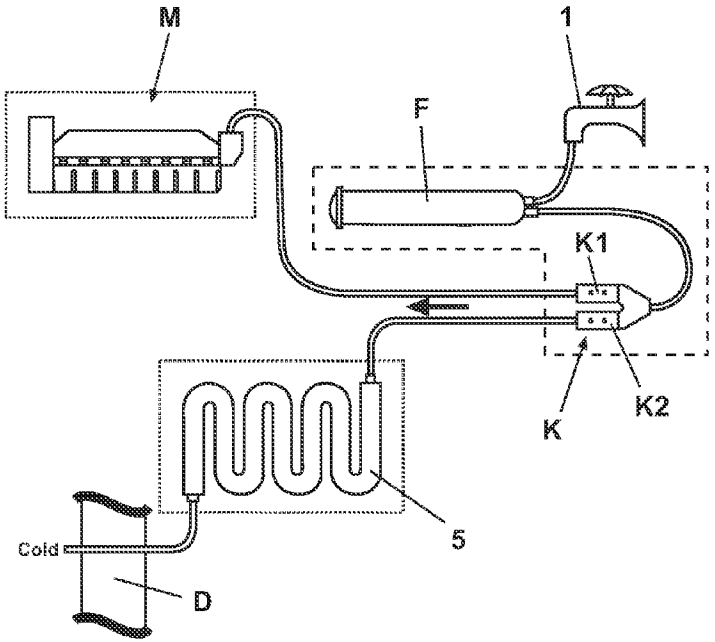
Fig. 2 (PRIOR ART)
FIG. 2 is a schematic view of the cold-water dispensing system of a refrigerator according to prior art.
Figure 1:
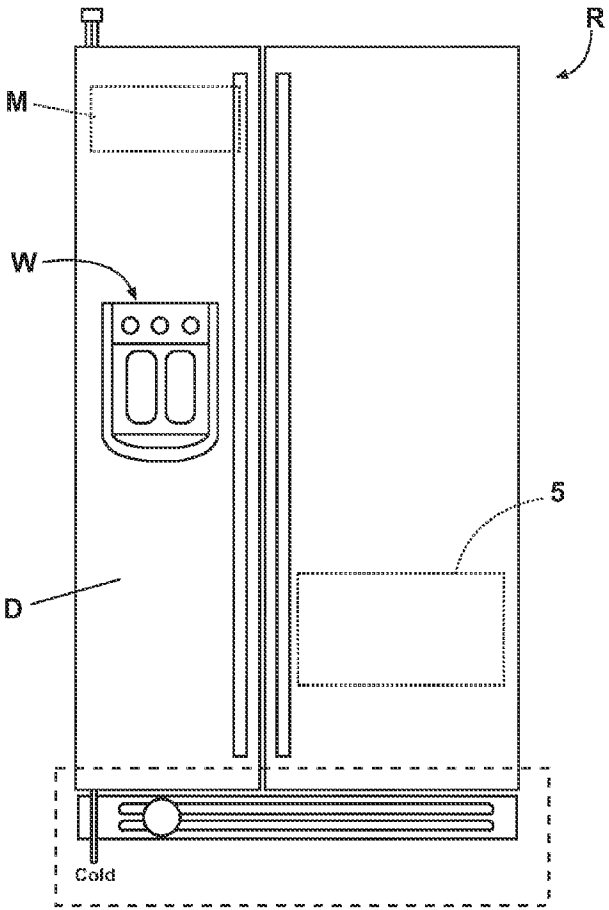
FIG. 1 is a front view of a side by side refrigerator with a water dispenser.

With reference to FIGS. 1 and 2, a side by side refrigerator R presents a door D of the freezing chamber. In the door D a water and ice dispenser W is provided, which is fed by a water tap 1 through a filter F and through a water reservoir 5 which, in the example shown in FIG. 2, is contained in the cooling compartment at a predetermined cold temperature. Between the filter F and the water reservoir 5 there is provided a T-branch K composed by 2 electrovalves K1 and K2 respectively, for delivering water also to an icemaker M contained in the freezing chamber.

During a normal operation mode in a refrigerator according to prior art (FIG. 2), filtered inlet water from tap 1 goes to the reservoir 5. From this latter a pipe goes through the door D and to the water dispenser W. Since the length of such pipe is not neglectable, the volume contained therein has a temperature which may be not the same of the water contained in the reservoir 5.

Figure 3:
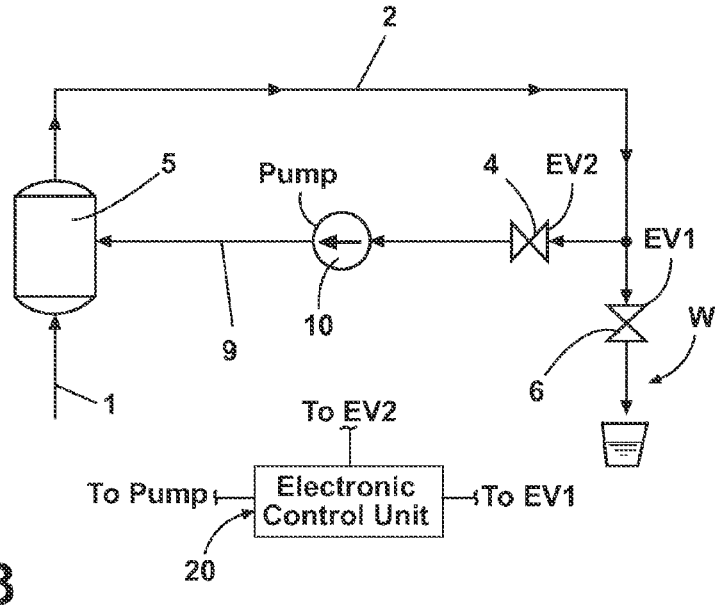
FIG. 3 is a schematic view of the cold or hot water dispensing system of a refrigerator according to a first embodiment of the invention.

According to a first embodiment of the present invention shown in FIG. 3, the water circuit comprises a pipe 2 which goes through the door and then to the dispenser area through an electrovalve 6. When the paddle on the dispenser is released, the electrovalve 6 remains closed and water flow stops.

Whenever is needed, either after every dispensing, or after a predetermined fixed time, the electronic control 20 which is provided with a predetermined simple algorithm opens an electrovalve 4 and switches on a pump 10 mounted on an auxiliary recirculation pipe 9. In this case, the water flows through the path 2-4-9-5 and back to the reservoir. The electronic control 20 runs this cycle automatically at selected time sequence to maintain the water into the pipe always at the correct temperature substantially identical to the temperature of water in the water reservoir 5. As an alternative, the pump 10 and the electrovalve 4 can be switched on only when the user acts on the paddle of the water dispenser W. In this case, the electronic control 20 waits few second before opening the electrovalve 6 so that the recirculation along the auxiliary pipe 9 can bring the temperature of water to the same level of the temperature of water inside the water reservoir 5.

This system solves the problem of water not at the desired level (hot or cold) at first dispensing and also prevent a too long permanence of water inside the piping, which could cause health and safety problems.

Figure 4:
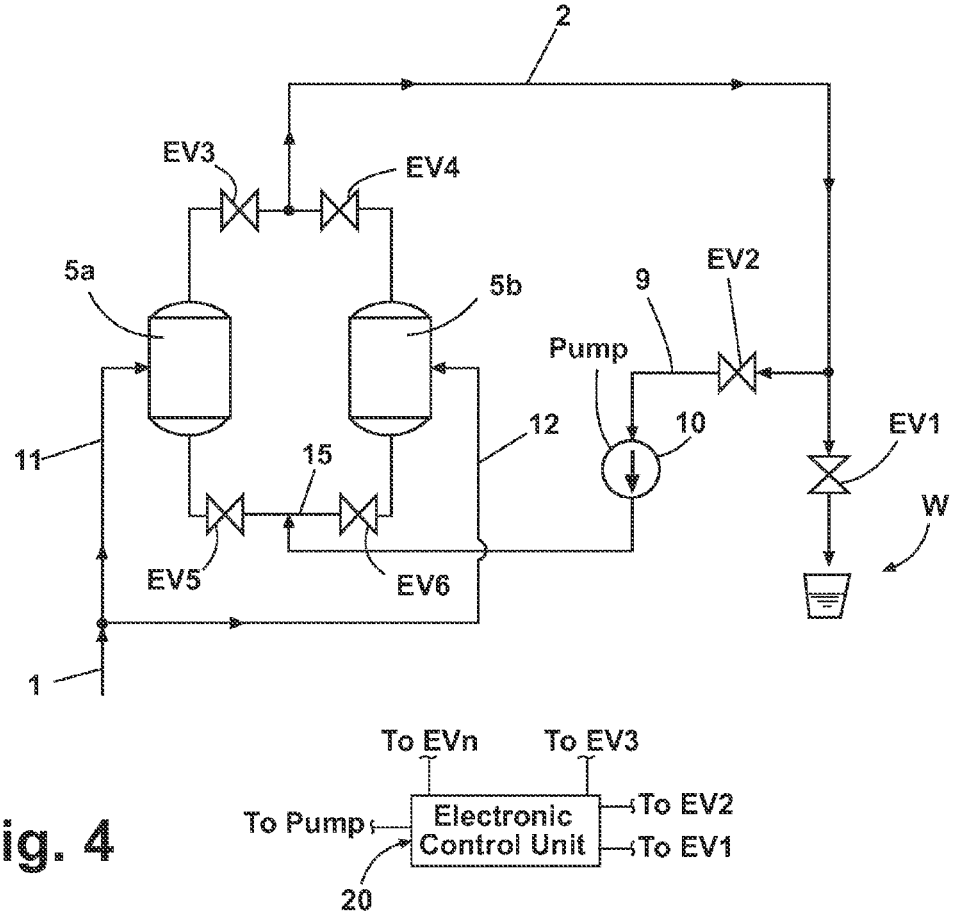
FIG. 4 is a schematic view of the cold and hot water dispensing system of a refrigerator according to a second embodiment of the invention.

With reference to FIG. 4, a second embodiment provides the same benefit to a refrigerator that has hot & cold water to be dispensed on the same dispenser W.

During normal operation mode, filtered inlet water line 1 is connected to both line 11 and line 12, and to the hot & cold reservoirs respectively 5*a* and 5*b*.

When the paddle for hot water is pushed, hot water goes from the hot reservoir 5*a* through the open electrovalve EV3 located in the base zone of the refrigerator and then, by means of the water line 2 which is inside the foam door, water is delivered to the dispenser W by an open electrovalve EV1.

When the paddle on the dispenser W is released, the electrovalve EV1 remains closed and the electronic control 20 which is provided with a predetermined algorithm opens the electrovalve EV2 so the water flows through the auxiliary line 9, and switches on the pump 10. The water flows then through the line 15 and the circuit opens an electrovalve EV5 located in the base zone of the refrigerator, so that water returns to the hot water reservoir 5*a*.

In this case the water flows is recirculated back to the reservoir 5*a*. The electronic control 20 runs this cycle automatically at selected time sequence to maintain the water into the pipe always at the correct temperature, or, as in the first embodiment, it can run the recirculation only when the user pushes the paddle for dispensing hot water.

When the paddle for the cold water is pushed, cold water goes from the cold reservoir 5*b* through the open electrovalve EV4, and then by the water line 2 to the dispenser W by the open electrovalve EV1.

When the paddle on the dispenser W is released, the electrovalve EV1 remains closed and the electronic control 20 opens the electrovalve EV2 so that the water is recirculated through auxiliary line 9 and by means of the pump 10, through an open electrovalve EV6 to the cold water reservoir 5*b*.

Also in this case the water flows back to the reservoir and the electronic control 20 runs this cycle automatically at selected time sequence to maintain the water into the pipe always at the correct temperature.

Figure 5:
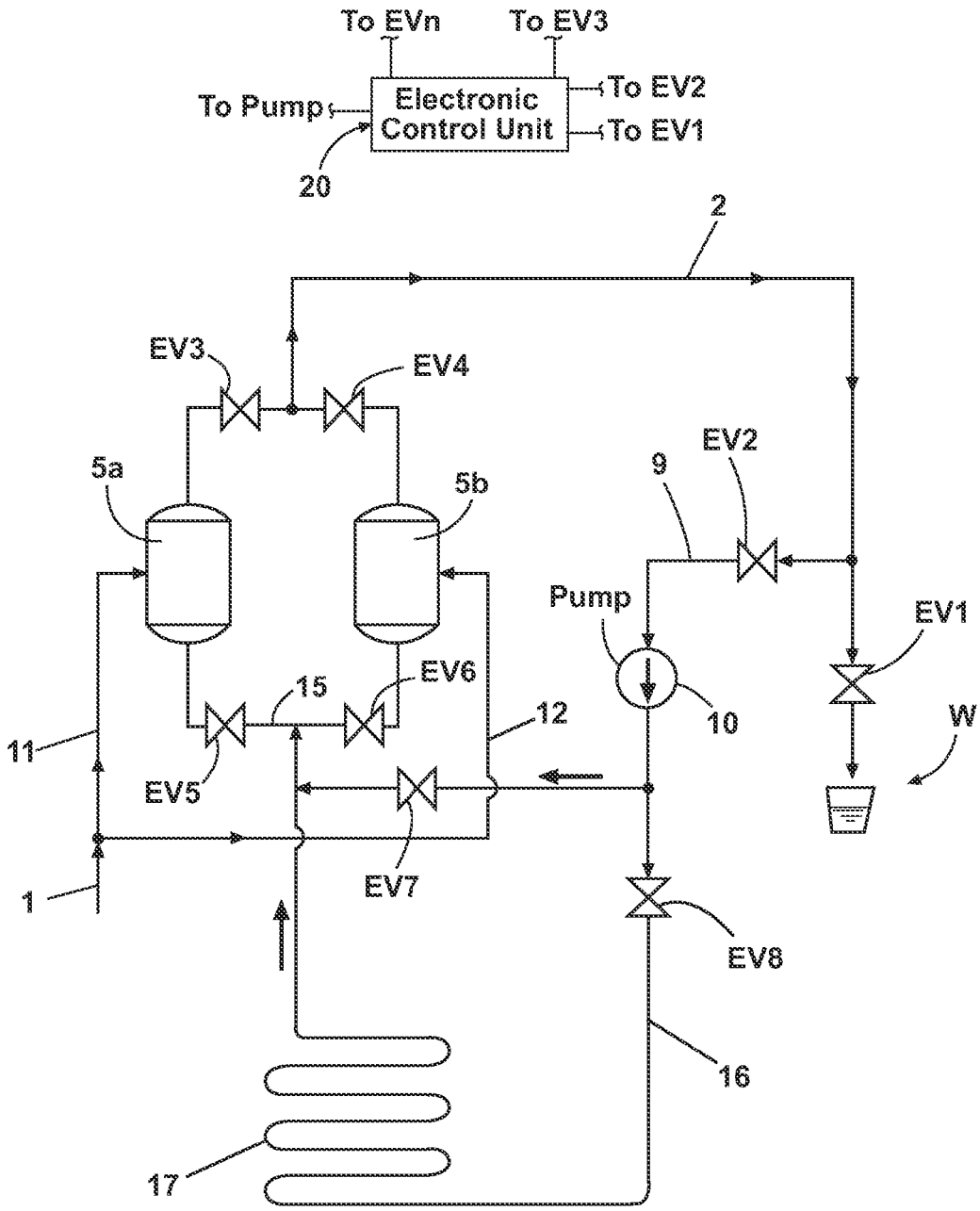
FIG. 5 is a schematic view of a water dispensing system according to a third embodiment of the invention.

With reference to FIG. 5, a third embodiment is focused also on fast water cooling. In FIG. 5 the components which are similar to those of FIG. 4 have the same reference numerals. During normal operation mode the refrigerator evaporator is cold and the cold water reservoir takes time to cool down in order to provide cold water at desired temperature, because cold is provided by force air circulation.

According to such third embodiment, a water pipe 16, with a portion 17 thereof in contact with the evaporator—not shown—(banded around, attached similarly to the electrical wire of the defrost heater), is connected to the water pump 10 by an electrovalve EV8 and on the other side to the line 15. An electrovalve EV7 closes the auxiliary line 10—EV7—15 when the water goes through the evaporator line.

Fast cooling feature is provided by keeping close the valve EV7, running the water pump 10 and opening the valve EV8, so that the water flows through the water pipe 17 in contact with the evaporator and goes back to the cold reservoir 5*b*. This technical solution allows faster water cooling inside the reservoir 5*b*.

This embodiment may also be used for a fast evaporator defrost. During normal operation mode the refrigerator evaporator is cold and when it is time to defrost it, the operation requires a long time and high heater power.

The circuit of FIG. 5 reduces dramatically the defrost time by sending hot water contained into reservoir 5*a* through the line 16 to the water pipe 17, which is in contact with the evaporator, by running the water pump 10 and by opening an electrovalve EV8. In this case the electrovalve EV7 is closed too.

An electronic control 20 manages those features accordingly to consumer water dispensing needs, and refrigerator operation mode.

Check or one-way valves to reduce cost and complexity of the system can replace some electrovalves. Moreover the present invention is independent on the system used for heating the water in the hot water reservoir 5*a*.

Instead of using two paddles for hot and cold water dispensing respectively, one paddle only can be used as well in combination with a device (for instance a button) for selecting hot or cold water.

We claim:

1. A refrigeration appliance comprising:

a hot water reservoir;

a cold water reservoir;

a dispenser having a first electrovalve for dispensing water on demand by a user;

a piping system forming a supply line comprising a first pipe fluidly coupling the hot and cold water reservoirs to the dispenser and a second electrovalve coupled with the first pipe and actuable to selectively supply water from the hot and cold water reservoirs to the dispenser;

an auxiliary piping system forming a recirculation line comprising a second pipe fluidly coupling the first pipe to the hot and cold water reservoirs and a third electrovalve coupled to the second pipe to selectively recirculate non-dispensed water from the piping system to one of the hot and cold water reservoirs; and wherein an electronic control controls the operation of the first, second, and third electrovalves such that the auxiliary piping system recirculates non-dispensed water from the piping system to one of the hot and cold water reservoirs prior to the piping system supplying water to the dispenser from one of the hot and cold water reservoirs based on the demand from the dispenser.

2. The refrigeration appliance according to claim 1, wherein the auxiliary piping system includes a pump connected to the electronic control.

3. The refrigeration appliance according to claim 2, wherein the auxiliary piping system further comprises a fourth electrovalve, which is connected to the electronic control such that the electronic control opens the fourth electrovalve and switches on the pump at a predetermined time.

4. The refrigeration appliance according to claim 1, wherein the piping system further comprises a branch in heat exchange relationship with an evaporator of the appliance in order to carry out a fast cooling of the recirculating water.

5. The refrigeration appliance according to claim 4, wherein that in the branch of the piping system hot water may be recirculated in order to carry out a quick defrost of the evaporator.

* * * * *